US006058811A

United States Patent [19]

Stuart

[11] Patent Number: 6,058,811

[45] Date of Patent: May 9, 2000

[54] POWER TONG WITH IMPROVED DOOR MECHANISM

[75] Inventor: Randolph L. Stuart, Odessa, Tex.

[73] Assignee: Eckel Manufacturing Company, Inc., Odessa, Tex.

[21] Appl. No.: 09/231,354

[22] Filed: Jan. 13, 1999

Related U.S. Application Data

[60] Provisional application No. 60/071,658, Jan. 16, 1998.

[51] Int. Cl.[7] ..... B25B 17/00

[52] U.S. Cl. ..... 81/57.15; 81/57.18; 81/57.33; 81/57.19

[58] Field of Search ..... 81/57.11, 57.15, 81/57.14, 57.2, 57.12, 57.18, 57.21, 57.33–57.35

[56] References Cited

U.S. PATENT DOCUMENTS

| | | | |
|---|---|---|---|
| 4,095,493 | 6/1978 | Haynes | 81/57.15 |
| 4,266,450 | 5/1981 | Farr et al. | 81/57.33 |
| 4,357,843 | 11/1982 | Peck et al. | 81/57.16 |
| 4,442,736 | 4/1984 | True et al. | 81/57.15 |
| 4,574,664 | 3/1986 | Curry . | |
| 4,593,584 | 6/1986 | Neves . | |
| 5,144,868 | 9/1992 | Feigel, Jr. | 81/57.15 |

*Primary Examiner*—James G. Smith
*Assistant Examiner*—Lee Wilson
*Attorney, Agent, or Firm*—Browning Bushman

[57] ABSTRACT

An open throat power tong includes a tong body 15 having an open throat 17 therein, a partial ring member 12 for rotating a tubular during a makeup or breakout operation, at least two heads 16 rotatable with the partial ring for gripping engagement with the tubular, and a drive motor 18, 20 for powering rotation of the partial ring. A door 40, 50 is pivotally connected to a tong body adjacent a side of the open throat to allow the power tong to be moved laterally on and off the tubular string. A latch arm 56, 84 is movable between a closed position and an opened position, with the latch arm including a latch head 58, 86 for engagement with a latch stop 60, 61 to latch the door in the closed position. A locking arm 66, 94 includes a locking member 70 for engagement with a locking stop 72. The door mechanism significantly reduces the force and effort required to reliably latch the door in the closed position, thereby improving tong safety.

20 Claims, 5 Drawing Sheets

POWER TONG WITH IMPROVED DOOR MECHANISM

This application claims the benefit of U.S. Provisional No. 60/071,658 filed Jan. 16, 1998.

FIELD OF THE INVENTION

The present invention relates to power tongs of the type commonly used to make up and break apart oilfield tubular threaded connections. More particularly, this invention relates to an open throat power tong which may be laterally moved on and off a tubular string, and to an improved door mechanism for such a power tong which will extend across the open throat when in the closed position and will expose the open throat when in the opened position.

BACKGROUND OF THE INVENTION

Power tongs have been used for decades to make up and break apart oilfield tubular connections. While such power tongs have a variety of configurations and different mechanisms are used to both grip and rotate an upper tubular relative to a lower tubular, such power tongs generally may be classified as being either the closed throat type or the open throat type. Closed throat power tongs provide a tong body which fully encircles the tubular string, so that repeated oilfield threaded connections pass anally through an opening in the closed throat power tong. The body of an open throat power tong, on the other hand, will typically encircle the majority of the oilfield tubular connection, but an open throat is provided in the tong body and also in the rotary ring which rotates within the tong body to allow the tong to be laterally moved on and off the tubular string. Most open throat power tongs are provided with a door which accordingly is opened to expose the open throat of the power tong when the tong is not being operated. The door of a power tong is closed when the power tong is operated to increase safety by preventing a tong operator from inadvertently engaging the rotating ring, and also to increase the reliable torque output of the power tong by preventing "spreading" of the open throat. In many oilfield operations, open throat power tongs having a door pivotally connected to the tong body are thus highly preferred over closed throat power tongs.

Various types of latching mechanisms have been used in the power tong industry to retain the pivotal door in the closed position. The commonly used latching mechanism in an open throat power tong employs a heavy duty hammer latch mechanism which includes a latch arm pivotally connected to one of the pair of doors positioned on opposing sides of the open throat. Alternatively, a single door may extend across the open throat, so that the latch arm on the door engages a lug on the tong body. In either case, a latch head at the end of the latch arm engages a latch lug or stop to retain the door or the pair of doors in the closed position. The latch head and the latch lug typically have planar surfaces which engage when the door or the pair of doors are in the closed position. The heavy duty latch mechanism and door are sufficient to withstand a substantial lateral force, and thus minimize spreading of the open throat of the power tong. To open the doors, the operator manually grasps a handle secured to the latch arm and pulls the latch arm away from the latch stop to disengage the mating surfaces. With the door or doors opened, a power tong may then be moved laterally on and off a tubular string.

When the open throat power tong is positioned about the tubular string and prior to activating the partial ring, the door with the latch stop is first closed, then the door with the latch arm is manually closed. The latch arm conventionally includes a spring member which biases the latch arm to the closed position relative to its supporting door. By applying a considerable closing force to the door supporting the latch arm, a cam surface on a latch head engages a corresponding cam surface on the latch stop which causes the latch arm to pivot toward an opened position while the latch head moves radially outward from the latch stop. Once the latch arm is pivotally moved to the opened position, the latch head moves radially inward relative to the latch stop so that the planar surfaces on the latch head and the latch stop engage. The spring on the latch arm serves to provide additional force which retains the doors closed.

A significant disadvantage of the power tong door mechanism discussed above is that it requires a large amount of closing force to shut the doors while the latch head moves radially outward with respect to the latch stop, so that the latch head will then be properly positioned so that it may move back radially inward relative to the latch stop and secure the doors closed. This large closing force requires that the door mechanism components be sized both for withstanding the spreading force discussed above, and also to ensure that components are sufficiently rugged to withstand the repeated substantially jarring force which these components endure during closing of the door A related drawback of this prior art system is that a great deal of effort is required by a tong operator to close the door, which unfortunately increases the tendency for the operator to merely position the door in the partially closed position and not fully latch the door closed. Failure to latch the door closed creates a safety risk, as discussed above, and may also result in tong spreading when high torque is used to make up or break apart the threaded connection. Moreover, it is often difficult for the tong operator to apply the necessary force to close the door under situations where the tong is not at a comfortable working level of, for example, four feet above the rig floor. In some cases, the tong may be positioned six feet above the rig floor and, in those situations, it is difficult for the tong operator to apply a sufficient force to reliably close the tong door.

The disadvantages of the prior art are overcome by the present invention. An improved open throat power tong and a door mechanism for such a power tong is hereinafter disclosed. The door mechanism of the present invention significantly reduces the amount of force required by the operator to reliably latch the door in the closed position.

SUMMARY OF THE INVENTION

An open throat power tong for making up and/or breaking apart an oilfield tubular connection comprises a tong body having an open throat therein, a partial ring member rotatably supported on the tong body for rotating one tubular relative to another during a make up and/or break out operation, at least two heads rotatable with the partial ring for gripping engagement with the upper oilfield tubular, and a drive motor for powering rotation of the partial ring. A door pivotally connected to the tong body adjacent a side of the open throat extends at least partially across the open throat when in the closed position, and when in the open position exposes the open throat to enable the power tong to be moved laterally on and off the oilfield tubular. A latch arm is moveable between a latch arm closed position and a latch arm opened position, with the latch arm including a latch head for engagement with a latch stop to latch the door in the closed position when the latch arm is in the closed position. A locking arm for retaining the latch arm in the opened position has a locking member secured thereto for engagement with a locking stop secured to a latch arm. The locking stop and locking member thus retain the latch arm in the latch arm opened position when the latch head is disengaged from the latch stop. The locking member disengages the locking stop during closing of the door.

The open throat power tong of the present invention improves safety by reducing the effort required by the operator to safely latch the door in the closed position before operating the tong. Closing of the door requires less manual effort than prior art door latching mechanisms, thereby also reducing fatigue on the tong operator.

In a preferred embodiment of the present invention, both a latch arm and a locking arm are pivotally connected to the door. The locking member may engage the locking stop during opening of the door to retain the latch arm in the latched arm opened position. The locking arm may be automatically pivoted relative to the latch arm during closing of the door to disengage the locking stop and the locking member. A spring is preferably provided for biasing the locking arm toward the door, and an adjustment member on the locking arm selectively positions a locking arm relative to the door when the door is in the closed position. A preferred door mechanism includes an engagement surface on the latch stop for contacting the locking arm during closing of the door to disengage the locking stop and the locking member, such that the locking arm remains in contact with the engagement surface when the door is in the closed position.

It is an object of the present invention to provide an open throat power tong with an improved door mechanism which will reliably latch the door in the closed position, and which reduces the force and thus the tong operator effort required to reliably close the door.

A related object of the present invention is to improve the safety of open throat power tongs by increasing the likelihood that the tong operator will reliably latch the door of an open throat power tong closed before operating the power tong.

Still another object of the present invention is to provide a door mechanism which includes a latch arm pivotally connected to the door and movable between a latch arm closed position and a latch arm opened position, with the latch arm including a latch head for engagement with a latch stop to latch the door in the closed position when both the door and the latch arm are in the closed position, a locking arm pivotally connected to the door for retaining the latch arm in the opened position, a locking stop secured to the latch arm, and a locking member secured to the locking arm for engagement with the locking stop to retain the latch arm in the latch arm opened position when the latch head is disengaged from the latch stop. This configuration allows the locking arm to automatically pivot relative to the latch arm during closing of the door to disengage the locking stop and the locking member, thereby reliably engaging the latch head and the latch stop to latch the door in the closed position.

It is a feature of the present invention that an engagement surface is provided for contacting the locking arm during closing of the door to disengage the locking stop and the locking member. The locking arm may remain in contact with the engagement surface when the door is in the closed position. The engagement surface may be provided on the latch stop.

Another feature of the invention is that the door mechanism for the power tong may include a single door which extends across the open throat of a power tong, or may include a pair of doors each pivotally connected to the tong body at opposing sides of the open throat of the power tong, with one of the doors supporting a latch stop thereon.

Yet another feature of the invention is that a biasing spring may be provided for biasing the locking arm toward the door. At least one of the locking stop and the locking member may have a ear cam surface thereon for engaging the other member to act against the biasing spring for moving the latch arm to the opened position during opening of the door.

Yet another feature of the invention is that an adjustment member may be provided on the locking arm for adjusting the position of the locking arm relative to the door when the door is in the closed position.

In order to minimize spreading of the open throat of the power tong when the door is latched, the door mechanism may be constructed such that the latch head has planar upper and lower latch surfaces each for engagement with a corresponding upper or lower latch surface on the latch stop to prevent spreading of the open throat during high torque applications.

An advantage of the present invention is that the fatigue on the operator is reduced by significantly reducing the effort required to latch the door in the closed position.

Yet another advantage of the invention is that the door mechanism is highly reliable and may be inexpensively manufactured.

These and further objects, features, and advantages of the present invention will become apparent from the following detailed description, wherein reference is made to figures in the accompanying drawings.

DETAILED DESCRIPTION OF PREFERRED EMBODIMENTS

Figure 1:
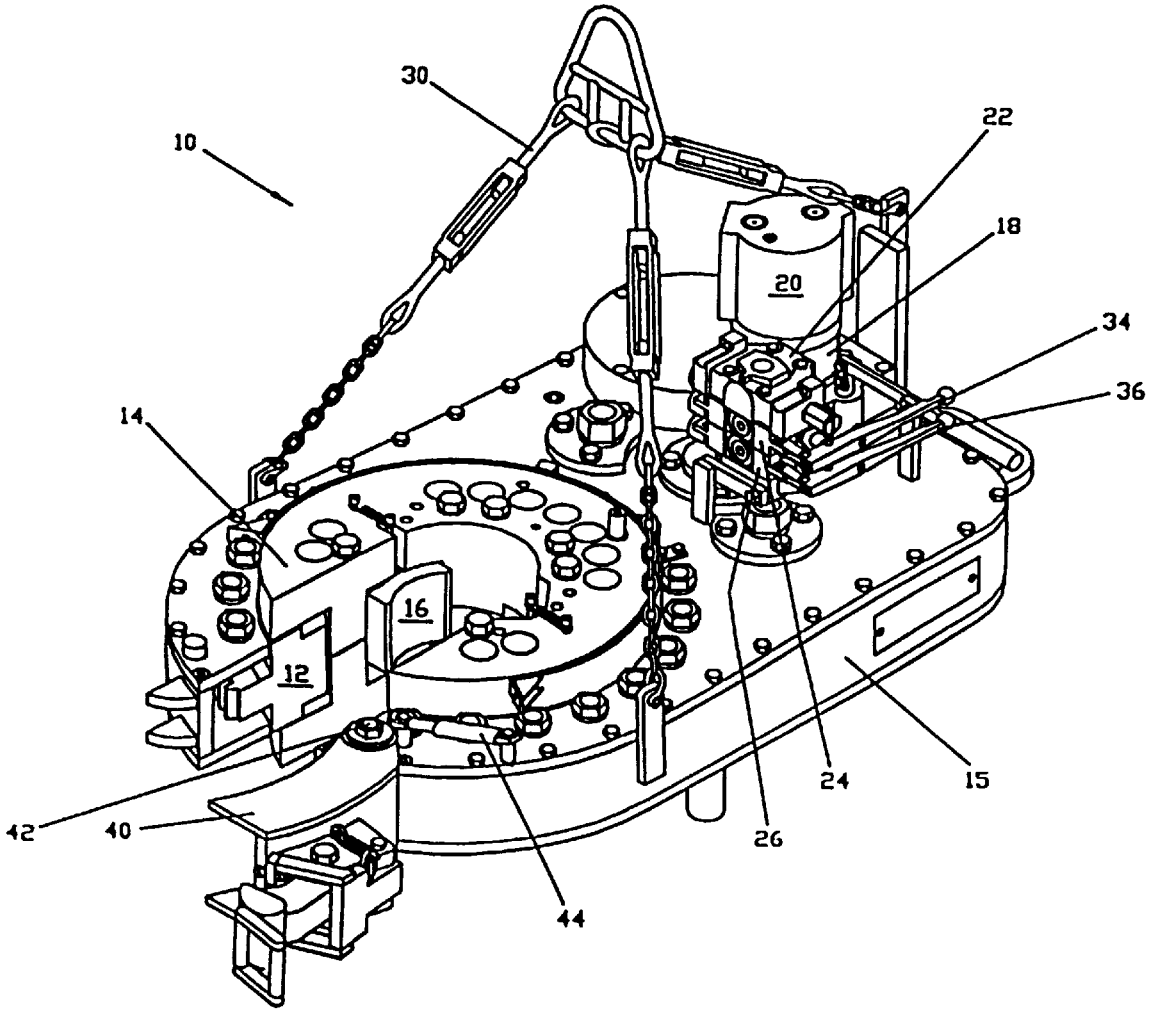
FIG. 1 generally depicts a power tong according to one embodiment of the present invention, with the door in the fully opened position.

FIG. 1 depicts one embodiment of a power tong 10 suitable for making up and/or breaking apart threaded tubular members, such as drill pipe, casing, or tubing. The power tong 10 is of the open throat type, with a partial ring member 12 and a cage plate assembly 14 both including open throat portions so that when these open throats are aligned as shown in FIG. 1, the tong may be laterally moved on and off a string of pipe. The hydraulic motors 18, 20 or other tong drive mechanism act to rotate the ring 12 relative to the cage plate 14, causing two or more dies 16 to come into gripping engagement with the pipe. Thereafter, both the partial ring 12 and cage plate 14 may be rotated together relative to the tong body or frame 15 to rotate or thread an upper pipe relative to a lower pipe.

Motors 18 and 20 may be powered by a skid-mounted hydraulic unit (not depicted) which supplies pressurized hydraulic fluid to the tong through conduit. Fluid is returned via another line to a tank (not shown) associated with the hydraulic unit. Hydraulic fluid may be directed to the motors through valve block 22, which includes valve assembly 24 for controlling fluid flow to the medium speed motor 18, and valve assembly 26 hydraulically in parallel with valve assembly 24 for controlling fluid flow to the high speed motor 20. Valve assembly 24 may be actuated by horizontal control handle 34, and valve assembly 26 may be actuated by vertical control handle 36. Representative flexible flowlines may be provided from the valves to their respective motors, as well as a representative gauge (not shown) for monitoring the fluid pressure to either or both of the motors. An adjustable suspension mechanism 30 is provided for supporting the tong body 15.

The open throat tong 10 is shown with a single door 40 each in the opened position. Door 40 is pivotally connected at 42 to the rigid body 15 of the tong adjacent the right-side of the open throat. When properly locked, the door acts to prevent "spreading" of the tong in the area of the open throat 17 under high make-up or break-out torques. A powered door closure optionally may be provided, and hydraulic cylinder 44 is shown between the tong body and the door 40 for that purpose. It should be understood that a similar powered door opening and closing cylinder (not shown) may be provided if both a right-side and a left-side door close over the open throat 17, as discussed subsequently. Alternatively, the door or pair of doors extending across the open throat 17 may be manually opened and closed by a tong operator, as discussed subsequently.

Figure 2:
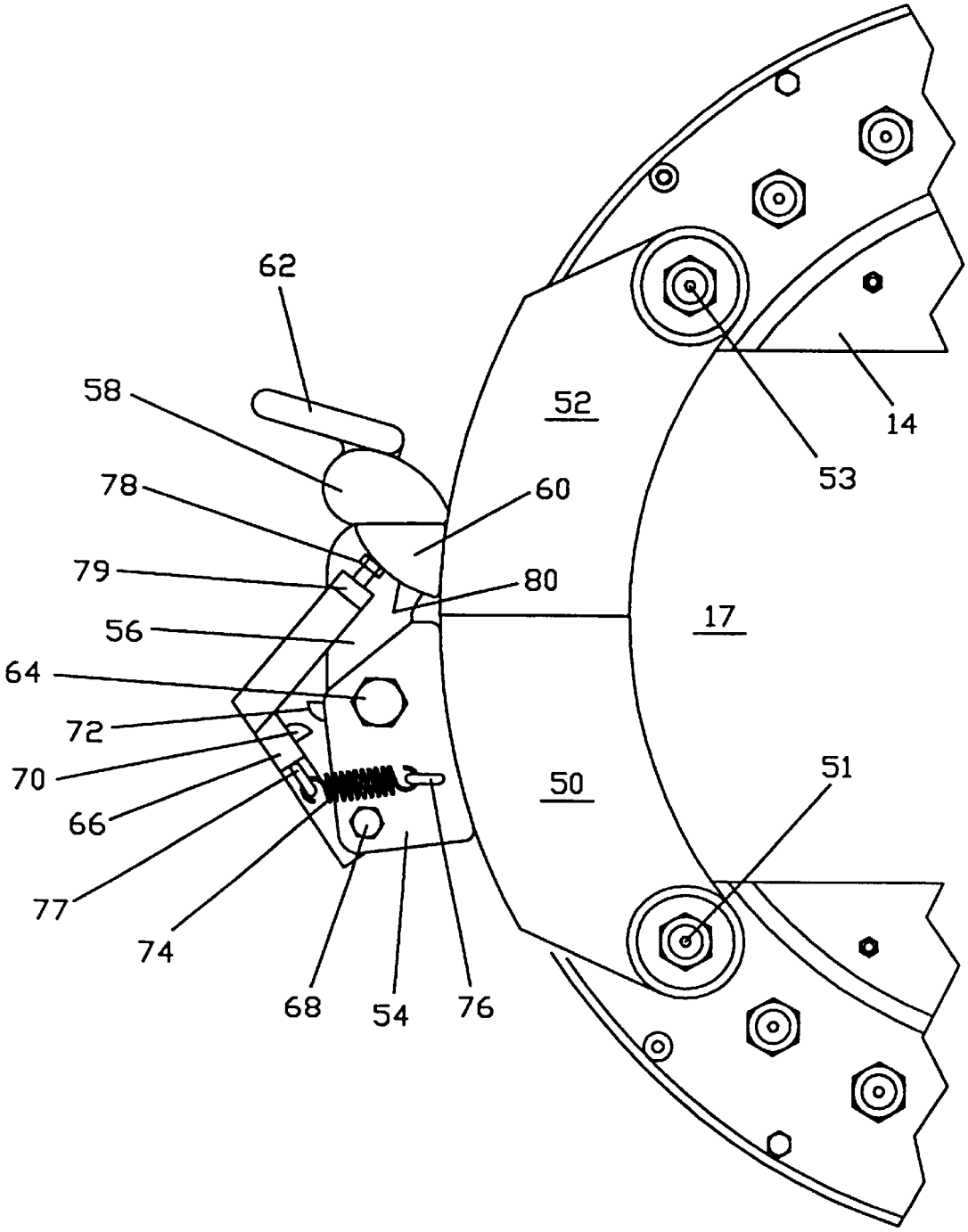
FIG. 2 is a top view of a portion of another embodiment of a power tong, with a right-side door and the left-side door each closed and the doors latched.

Referring now to FIG. 2, a portion of another power tong is shown which includes a partial ring and a cage plate assembly 14 each having an open throat 17 and rotatable with respect to the tong frame 15, as discussed above. For each of the Figures, the same reference numerals are generally used for components which are similar to components previously described. For this embodiment, a pair of doors 50 and 52 are each pivotally connected to the tong body 15 about a respective pivot axis 51 and 53, respectively. A pair of vertically spaced upper and lower latch ears 54 are each weldably affixed to the door 50. The latch arm 56 is fitted between the pair of latch ears 54, and pivots about the axis of latch pin 64. The latch arm 56 includes a latch head 58 at the cantilevered end thereof, and a handle 62 is secured to the latch head 58 for manually opening and closing the latch arm 56 and the door 52, as discussed subsequently. As shown in FIG. 2, the latch head 58 is in engagement with the latch lug or latch stop 60 to retain the doors 50, 52 in the closed and latched position. Mating engagement of the latch head on the door 40 shown in FIG. 1 with the latch lug or latch stop affixed to the frame 15 will similarly hold the single door in the closed and latched position.

The door mechanism as shown in FIG. 2 also includes a locking arm 66, which may be in the form of a bracket pivotally connected at 68 to the pair of latch ears 54. The locking arm 66 includes a locking member 70 affixed thereto for mating engagement with a locking stop which is secured to the latch arm 56. The locking arm 66 is biased toward both the door 50 and the latch arm 56 by biasing member 74, which may be a conventional tension spring. As shown in FIG. 2, the tension spring acts between the unshaped connection 76 secured to one of the latch ears 54, and a suitable spring end connector 77 secured to the locking arm 66. The locking arm 66 also includes an end adjustment member 78, which maybe a threaded bolt which mates with a nut 79 welded to the bracket of the locking arm 66. The head of the bolt 78 engages the curvilinear surface 80 of the latch stop 60, as shown in FIG. 2, to place the spring 74 in tension and to move the locking member 70 out of engagement with the locking stop 72. As shown in FIG. 2, the door mechanism holds the doors 50 and 52 in the latched and closed position by the mating engagement of the latch head 58 with the latch lug or stop 60. The components of the mechanism shown in FIG. 2 are sufficiently rugged to withstand a substantial lateral force extending between the pivot points 51 and 53 which otherwise would cause undesirable spreading of the open throat 17 of the power tong when operated under high torque conditions.

Figure 3:
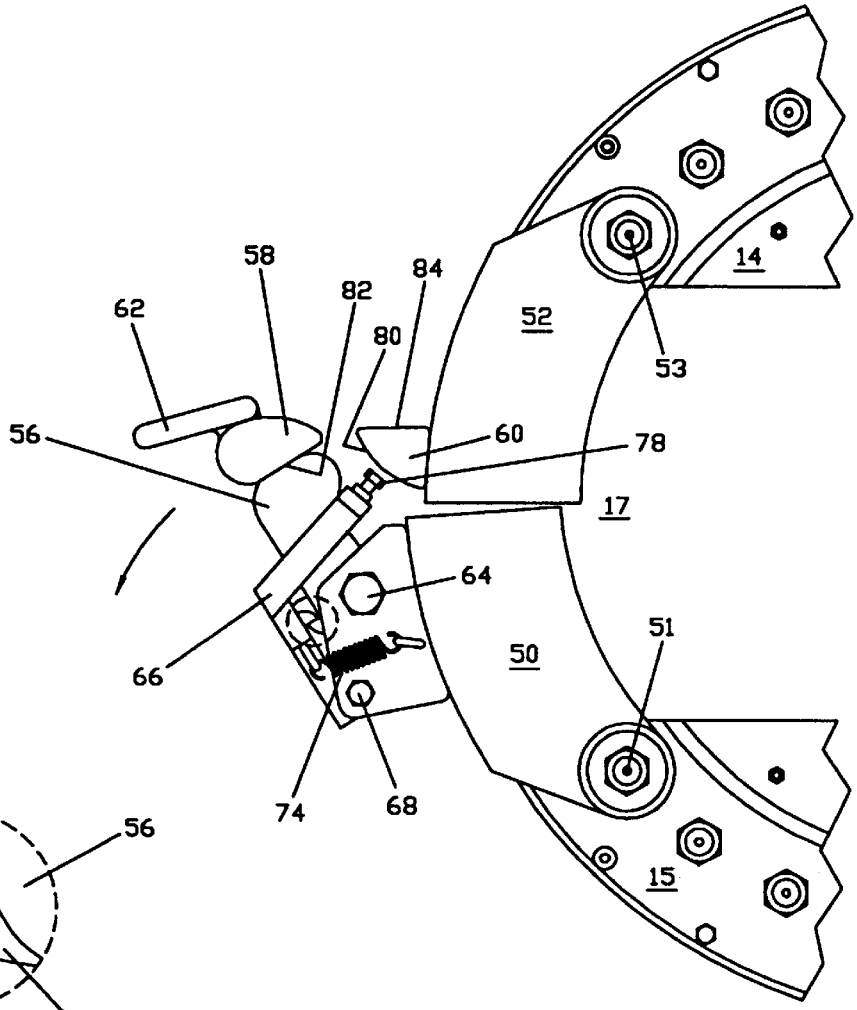
FIG. 3 is a top view of the portion of the power tong shown in FIG. 2, with a latch arm pulled open manually so that the locking arm holds the latch arm in the opened position.
Figure 3A:
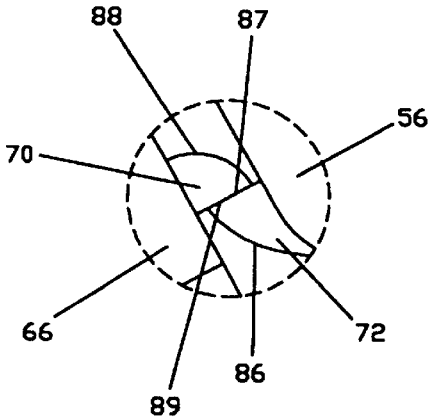
FIG. 3A is an enlarged view of a portion of the mechanism shown in FIG. 3.

When the power tong is not being operated, i.e., when neither the partial ring nor the cage plate assembly are rotated, and with the open throat of both the partial ring and the cage plate assembly aligned with the open throat 17 in the tong body, the tong operator may grasp the handle 62 to pull the latch arm 56 outward and away from the tong body, thereby disengaging the planar surface 82 of the latch head 58 from the planar surface 84 of the latch lug 60. During this disengagement, the latch arm 56 thus pivots with respect to the door 50 about the axis of the latch pin 64. This operation also causes the curvilinear cam surface 86 of the locking stop 72 to engage the curvilinear cam surface 88 and the locking member 70, which stretches the spring 74 to disengage the bolt 78 from the engagement surface 80. Once the tip end of the locking stop 72 passes by the tip end of the locking member 70, the planar surface 87 on the locking stop engages the mating planar surface 89 on a locking member, and the spring 78 then moves the latch arm 66 toward the door 50, thereby temporarily locking the latch arm 56 in the open position. The continued opening of the door in response to the tong operator pulling on the handle 62 will rotate the door 50 in a counterclockwise direction away from the closed to the partially opened position, as shown in FIG. 3. Those skilled in the art will appreciate that the action described in this paragraph occurs both automatically in response to the tong operator pulling on the handle 62 and in a very short time interval once the operator begins to open the door.

Once the locking arm 66 is held in the opened position by the mating engagement of the locking stop and the locking member and the earlier occurring disengagement of the latch head and the latch stop, the door 50 may be further opened by the tong operator pulling on the handle 62 until the door 50 in the fully opened position. The tong operator may then also rotate the door 52 in the clockwise direction about the axis 53 so that both the doors are in the opened position, at which time the tong may be laterally moved off the tubular string.

Figure 4:
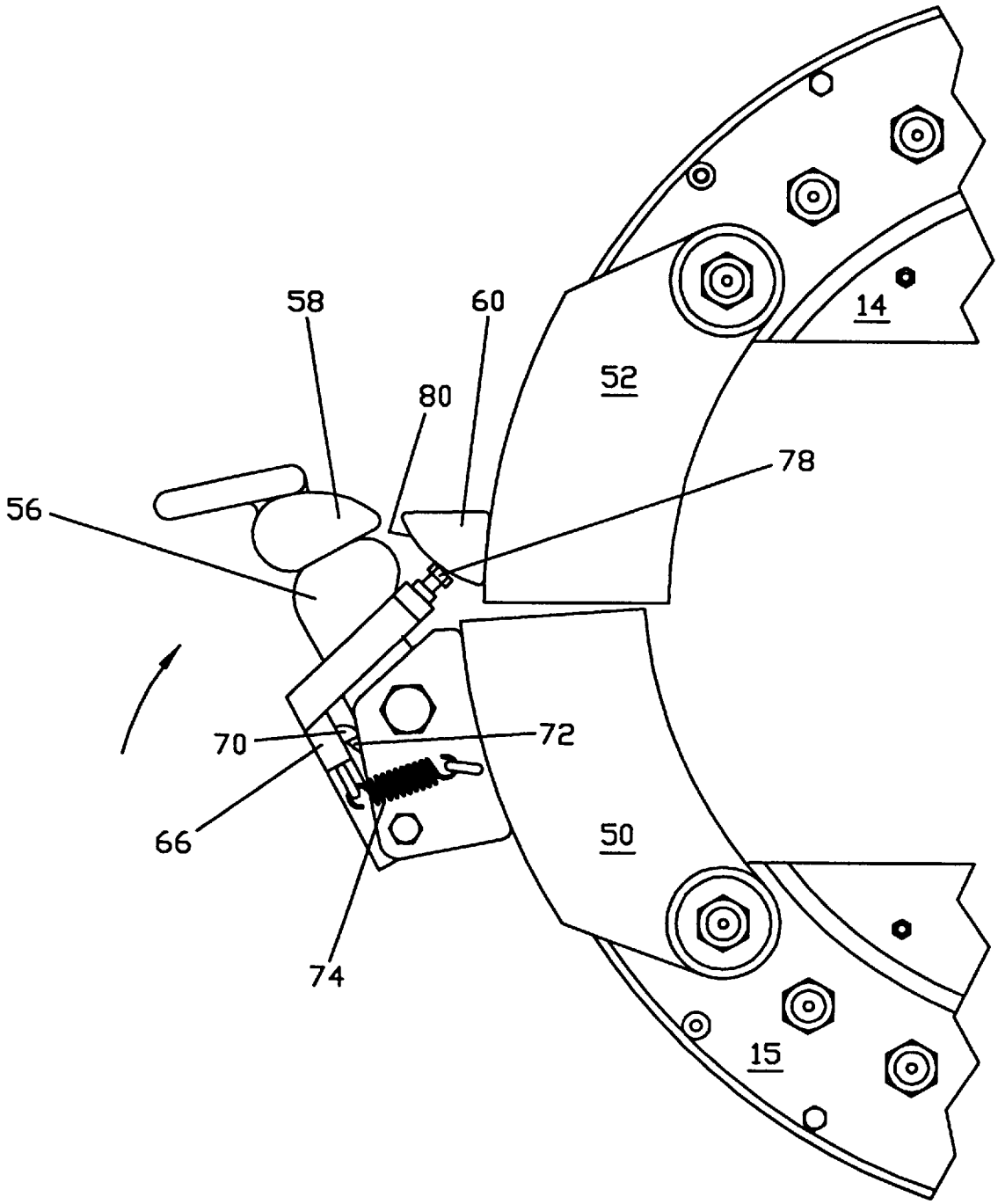
FIG. 4 is a top view of the portion of the power tong shown in FIG. 2, with the left door in the closed position and the right door being swung shut so that the locking arm engages the latch stop.

When it is subsequently desired to move the tong back on to the tubular string (typically to make up or break apart another threaded connection), the tong may simply be moved so that the tubular string is radially within the partial ring and the cage plate assembly, during which operation the doors 50 and 52 are open. Once the tubular is positioned within the tong, the door 52 may first be manually rotated to the fully closed position The door 50 may then be swung toward the closed position, as shown in FIG. 4, until the bolt head 78 engages the surface 80 of the latch lug 60. Engagement of adjustment mechanism 78 with the surface 80 will then move the locking arm 66 to an extended position away from both the door 50 and the latch arm 56, which causes the disengagement of the locking stop 72 and the locking member 70, thereby stretching the spring 74. By the engagement of the locking stop 72 with a locking member 70, the latch arm 56 would desirably be retained at this time in the open position, as shown in FIG. 4. Accordingly, the latch head 58 will be positioned so that the further closing of the door 50 will cause the latch head 58 to pass over the latch stop 60, thereby returning these components into latched engagement. With these components latched, the locking arm 66 will then return to its retracted position, as shown in FIG. 2. Accordingly, closing of the door automatically causes the locking arm 66 to move from the locking arm retracted position, as shown in FIG. 4 to hold the latch arm 56 in the opened position, to the locking arm extended position, as shown in FIG. 2 to allow the latch arm 56 to move to the closed position in response to a biasing member, such as the latch spring discussed subsequently.

For the embodiments discussed herein, the adjustment member 78 engages the curved surface 80 on the latch lug or latch stop 60. Those skilled in the art will appreciate that the locking arm may be configured for engaging any other component on the door 52, and for the FIG. 1 embodiment any suitable component on the tong body 15, for moving the locking arm to the extended position when the door or doors are closed.

As shown in FIG. 2, when a pair of doors are provided each extending partially across the open throat 17 of the tong body, each of the doors has a closing face which, when the doors are closed, is closely adjacent and is spaced substantially centrally within the open throat 17 of the tong body.

Figure 5:
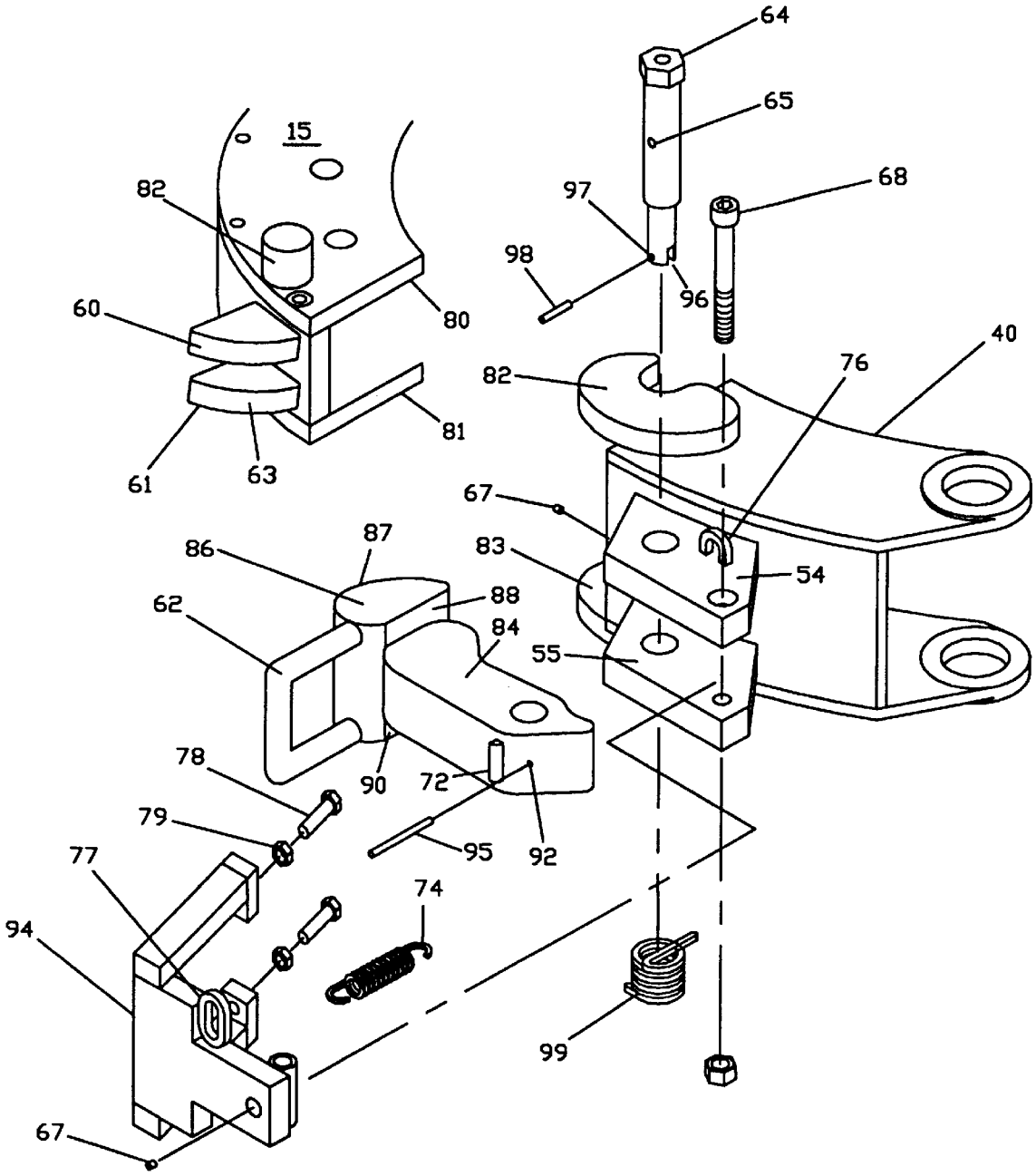
FIG. 5 is an exploded view of one embodiment of a door mechanism according to the present invention.

FIG. 5 is an exploded view of one embodiment of a door mechanism according to the present invention, and more particularly a door mechanism for an open throat power tong as generally shown in FIG. 1, with a single door 40 extending across the open throat of the tong, rather than the left-side and right-side doors as shown in FIGS. 2–4. Those skilled in the art will appreciate that the tong body 15 conventionally includes an upper tong plate 80 and a lower tong plate 81. In addition to the upper and lower latch ears 54 and 55, the door also may include an upper latch plate 82 and a similar lower latch plate 83 each adapted for engagement with a respective cylindrical shaped post 82 extending upward from the top plate 80 and downward from the bottom plate 81. The slots 79 in each of the ears 82 and 83 are thus sized for receiving a respective post 82, and thereby provide additional components to resist lateral spreading of the open throat of the tong when the door 40 is latched closed.

FIG. 5 also depicts that the latch stop may include an upper lug 60 and a lower lug 61 which are positioned for engagement with the planar surfaces 88 and 90, respectively, on the latch head 86, which is secured to the latch arm 84. The locking arm 94 includes an adjustment bolt 78 as discussed above, with the spring 74 biasing the locking arm 94 toward the door 40. One end of the spring is secured to the member 76 affixed to the latch ear 54. The other end of the spring 74 is secured to the locking arm 94 by a link shaped connector 77, which in turn may be secured to the locking arm 94 by conventional bolt and nut.

The locking pin 64 is shown to include a lower slot 96 and an aperture 97 for receiving a pin 98. The spring pin 98 thus retains the leg of the torsion spring 99 within the slot 96 in the latch pin 64. An extending leg of the torsion latch spring 99 fits within the slot 96, while another extending leg of the spring 99 is continuously in engagement with the door 40. Another pin 95 may be fitted into aperture 92 in the latch arm 84 and into the aperture 65 in the latch pin 64 to couple the latch pin to the latch arm. Those skilled in the art will appreciate that during assembly of the door mechanism, the torsion spring 99 may be rotated one half turn or more to place a desired bias on the torsion spring 99 which will continually bias the latch arm 84 to the closed position. The latch spring 99 thus exerts a continual force on the locking arm 84 to bias the locking arm toward the closed position. Opening the latch arm to engage the locking member 70 and the locking stop 72 creates additional tension on this torsion spring 99. One or more grease fittings 67 as shown in FIG. 5 may be provided for lubricating the movable components of the door mechanism.

Those skilled in the art will appreciate that various biasing mechanisms other than springs may be used for the purposes discussed herein. Biasing mechanisms are preferably provided to facilitate the substantially automatic action of the door mechanism during the door opening and door closing operations. The biasing members could be eliminated in some embodiments, but this may then require the tong operator to manually position one component relative to another. A positioned component may then held in that position by friction until moved to a new position. The positioned or movable component may also act as a positive stop to maintain the components in the desired position until manually moved by the operator. A locking stop and locking member each with a curved cam surface thereon are similarly well suited to allow the substantially automatic operation of temporarily holding the latch arm in the open position. Other types of locking members and locking stops could be provided. For example, in another embodiment a locking stop and locking member each having a bar-shaped configuration with a substantially rectangular cross-sectional configuration may be used for holding the locking arm in the closed position. The spring 74 may then be eliminated, and the operator may selectively position one bar behind the other bar to temporarily lock the latch arm in the opened position.

The end surface 87 on the locking head and the corresponding end surfaces 63 on the latching lugs need not be curvilinear, since these surfaces need not engage for the door mechanism or disclosed herein to operate. These surfaces may nevertheless be curvilinear, as shown in the drawings, so that even if the locking bar were removed, the curved surface 87 would engage the curved surfaces 63 and allow the door mechanism to latch in a manner substantially similar to prior art mechanisms.

The door mechanism of the present invention is ideally suited for retrofitting an existing power tong having a conventional door mechanism with the improved door mechanism of the present invention. Those skilled in the art will appreciate that during this retrofitting operation, the door itself and the latch stop may be reused, and the other components of the door mechanism as discussed herein may be added to the assembly. It should also be understood, however, that an improved power tong according to the present invention may be initially manufactured with a tong body having an open throat, a partial ring member rotatably supported on the tong body, at least two heads rotatable with the partial ring, a drive motor for powering rotation of the partial ring, and the door mechanism as discussed herein for latching the door in the closed and latched position. A significant benefit to such power tong is the reduced effort required by the tong operator to close the door of the open throat power tong, which thereby increases the tendency of the tong operator to properly latch the door closed and thereby minimize both the safety risk and tong spreading.

The door mechanism of the present invention is particularly well suited for extending at least partially across the open throat of a power tong, but may also be used in other oilfield applications for equipment having open throats therein. For example, the door of the present invention may be used to extend across the open throat of a backup tong which may not include a partial ring member or a drive motor for powering rotation of the partial ring. Many types of backup tongs have open throats, and in such tongs a door may be provided for closing across the open throat to minimize the safety risk to the tong operator. The door mechanism of the present invention may also be used with other oilfield tools or equipment. Elevators are exemplary of other equipment which may have an open throat and which may benefit from the improved door mechanism in the present invention.

Although particular embodiments of the apparatus of the invention and the method of practicing the invention have been shown and described herein, it should be apparent that various changes and modifications may be made without departing from the broader aspects of the invention. Accordingly, the purpose of the following claims is to cover such changes and modifications that fall within the spirit and scope of the invention.

What is claimed is:

1. A door mechanism for a power tong having a tong body with an open throat therein, the door mechanism, comprising:

a door pivotally connected to the tong body adjacent a side of the open throat to extend at least partially across the open throat when in the closed position and to expose the open throat of the power tong when in the opened position to enable the power tong to be moved laterally on or off a tubular string;

a latch arm pivotally connected to the door and movable between a latch arm closed position and a latch arm opened position, the latch arm including a latch head for engagement with a latch stop to latch the door in the closed position when both the door and the latch arm are in the closed position;

a locking arm pivotally connected to the door for retaining the latch arm in the opened position;

a locking stop secured to the latch arm; and a locking member secured to the locking arm for engagement with the locking stop to retain the latch arm in the latch arm opened position when the latch head is disengaged from the latch stop, the locking arm automatically pivoting relative to the latch arm during closing of the door to disengage the locking stop and the locking member.

2. The door mechanism as defined in claim 1, further comprising:

an engagement surface fixed relative to the latch stop for contacting the locking arm during closing of the door to disengage the locking stop and the locking member, and wherein the locking arm remaining in contact with the engagement surface when the door is in the closed position.

3. The door mechanism as defined in claim 2, wherein the engagement surface is provided on the latch stop.

4. The door mechanism as defined in claim 1, further comprising:

another door pivotally connected to the tong body at an opposing side of the open throat of the power tong, the another door supporting the latch stop thereon.

5. The door mechanism as defined in claim 4, further comprising:

the door having a door closing face, the another door having another door closing face, and the door closing face and the another closing face each being spaced substantially centrally within the open throat of the tong body when the door and the another door are closed.

6. The door mechanism as defined in claim 1, further comprising:

a biasing spring acting between the door and the locking arm for biasing the locking arm toward the door.

7. The door mechanism as defined in claim 6, wherein at least one of the locking stop and the locking member has a curvilinear cam surface thereon for engaging the other of the locking stop and locking member to act against the bias of the spring when moving the latch arm to the opened position during opening of the door.

8. The door mechanism as defined in claim 7, wherein both locking stop and the locking member have the curvilinear cam surface thereon, such that the cam surface on the locking member engages the cam surface on the locking stop during opening of the door.

9. The door mechanism as defined in claim 1, further comprising:

an adjustment member on the locking arm for adjusting the position of the locking arm relative to the door when the door is in the closed position.

10. The door mechanism as defined in claim 1, further comprising:

the latch head having upper and lower planar latch surfaces thereon, the latch stop having corresponding upper and lower planar stop surfaces thereon, each planar latch surface engaging a respective planar stop surface when the door is in the closed position.

11. The door mechanism as defined in claim 1, further comprising:

a handle on the latch arm for manually opening of the door.

12. A door mechanism for closing at least partially across an open throat of an oilfield tool, the door mechanism comprising:

a door pivotally connected to the tool adjacent a side of the open throat to extend at least partially across the open throat when in the closed position and to expose the open throat of tool when in the opened position to enable the tool to be moved laterally on or off a tubular string;

a latch arm pivotally connected to the door and movable between a latch arm closed position and a latch arm opened position, the latch arm including a latch head for engagement with a latch stop to latch the door in the closed position when both the door and the latch arm are in the closed position;

a locking arm pivotally connected to the door for retaining the latch arm in the opened position;

a locking stop secured to the latch arm; and a locking member secured to the locking arm for engagement with the locking stop to retain the latch arm in the latch arm opened position when the latch head is disengaged from the latch stop, the locking arm being automatically pivoted relative to the latch arm during closing of the door to disengage the locking stop and the locking member;

a biasing spring acting between the door and the locking arm for biasing the locking arm toward the door;

at least one of the locking stop and the locking member has a curvilinear cam surface thereon for engaging the other of the locking stop and locking member to act against the bias of the spring when moving the latch arm to the opened position during opening of the door; and an engagement surface fixed relative to the latch stop for contacting the locking arm during closing of the door to disengage the locking stop and the locking member.

13. The door mechanism as defined in claim 12, further comprising:

another door pivotally connected to the tong body at an opposing side of the open throat of the power tong, the another door supporting the latch stop thereon; and the door having a door closing face, the another door having another door closing face, and the door closing face and the another closing face each being spaced substantially centrally within the open throat of the tong body when the door and the another door are closed.

14. The door mechanism as defined in claim 12, further comprising:

an adjustment member on the locking arm for adjusting the position of the locking arm relative to the door when the door is in the closed position.

15. An open throat power tong for making up and/or breaking apart an oilfield tubular connection, comprising:

a tong body having an open throat therein;

a partial ring member rotatably supported by the tong body for rotating a tubular during a makeup and/or break out operation;

at least two heads rotatable with the partial ring for gripping engagement with the oilfield tubular connection;

a drive motor for powering rotation of the partial ring;

a door pivotally connected to the tong body adjacent a side of the open throat to extend at least partially across the open throat when in the closed position and to expose the open throat of the power tong when in the opened position to enable the power tong to be moved laterally on or off a tubular string;

a latch arm movable between a latch arm closed position and a latch arm opened position, the latch arm including a latch head for engagement with a latch stop to latch the door in the closed position when both the door and the latch arm are in the closed position;

a locking arm for retaining the latch arm in the opened position;

a locking stop secured to the latch arm; and a locking member secured to the locking arm for engagement with the locking stop to retain the latch arm in the latch arm opened position when the latch head is disengaged from the latch stop, the locking member disengaging the locking stop during closing of the door.

16. The open throat power tong as defined in claim 15, further comprising:

an engagement surface fixed relative to the latch stop for contacting the locking arm during closing of the door to disengage the locking stop and the locking member, and wherein the locking arm remaining in contact with the engagement surface when the door is in the closed position.

17. The open throat power tong as defined in claim 15, further comprising:

another door pivotally connected to the tong body at an opposing side of the open throat of the power tong, the another door supporting the latch stop thereon; and the door having a door closing face, the another door having another door closing face, and the door closing face and the another closing face each being spaced substantially centrally within the open throat of the tong body when the door and the another door are closed.

18. The open throat power tong as defined in claim 15, further comprising:

a biasing spring acting between the door and the locking arm for biasing the locking arm toward the door; and wherein at least one of the locking stop and the locking member has a curvilinear cam surface thereon for engaging the other of the locking stop and locking member to act against the bias of the spring when moving the latch arm to the opened position during opening of the door.

19. The open throat power tong as defined in claim 15, further comprising:

an adjustment member on the locking arm for adjusting the position of the locking arm relative to the door when the door is in the closed position.

20. The open throat power tong as defined in claim 15, further comprising:

the latch head having upper and lower planar latch surfaces thereon, the latch stop having corresponding upper and lower planar stop surfaces thereon, each planar latch surface engaging a respective planar stop surface when the door is in the closed position.

* * * * *